US005487465A

United States Patent [19]

Broskow

[11] Patent Number: 5,487,465

[45] Date of Patent: Jan. 30, 1996

[54] CONTAINER CARRIER

[75] Inventor: James A. Broskow, Buffalo Grove, Ill.

[73] Assignee: Illinois Tool Works Inc., Glenview, Ill.

[21] Appl. No.: 230,308

[22] Filed: Apr. 20, 1994

[51] Int. Cl.[6] ..... B65D 71/00

[52] U.S. Cl. ..... 206/150; 206/151; 206/162; 206/199; 294/87.2

[58] Field of Search ..... 206/150, 151, 206/161, 162, 199; 294/87.2; 220/DIG. 29; 383/107

[56] References Cited

U.S. PATENT DOCUMENTS

| | | | |
|---|---|---|---|
| 2,650,128 | 8/1953 | Failor . | |
| 2,680,038 | 6/1954 | Gray . | |
| 2,719,100 | 9/1955 | Banigan | 383/107 X |
| 2,874,835 | 2/1959 | Poupitch . | |
| 2,994,426 | 8/1961 | Biesecker et al. . | |
| 3,191,849 | 6/1965 | Gutowski et al. | 383/107 X |
| 3,204,386 | 9/1965 | Creed et al. . | |
| 3,307,321 | 3/1967 | Beart . | |
| 3,314,591 | 4/1967 | Cheeley | 383/107 X |
| 3,383,827 | 5/1968 | Schaich | 206/158 X |
| 3,608,949 | 9/1971 | Owen . | |
| 3,738,698 | 6/1973 | Helms | 294/87.2 |
| 3,744,704 | 7/1973 | Struble . | |
| 3,868,140 | 2/1975 | Gordon . | |
| 4,103,811 | 8/1978 | Owen | 206/150 |
| 4,250,682 | 2/1981 | Braun . | |
| 4,919,260 | 4/1990 | Cunningham | 206/150 |

*Primary Examiner*—Bryon P. Gehman

*Attorney, Agent, or Firm*—Trexler, Bushnell, Giangiorgi & Blackstone, Ltd.

[57] ABSTRACT

A plastic carrier for carrying containers includes container engaging portions which extend from a joint. The joint is at adjacent edges of the container engaging portions. The container engaging portions include a plurality of annular bands for securely holding containers therein. The joint is formed by bonding the layers of plastic material between the edges of the container engaging portions. The joint is interrupted along its length to enable the joint and container engaging portions to stretch when containers are placed in the carrier. The carrier may include a handle portion which extends from the joint for carrying the containers.

13 Claims, 2 Drawing Sheets

CONTAINER CARRIER

BACKGROUND OF THE INVENTION

This invention is generally directed to a plastic carrier for carrying container such as bottles, cans and the like. More particularly, the invention contemplates a plastic carrier which includes a joint between two container carrying portions that can be stretched over the containers without breaking or shearing.

Prior art container carriers, such as the one disclosed in U.S. Pat. No. 2,650,128 to Failor, are made of a single sheet of material, usually cardboard, which is folded in half to form free moving flaps and a handle which extends between the flaps upwardly. The flaps hold the containers in shaped apertures. Since the cardboard sheet is folded in half to make the container, the handle is of a double thickness. The sides of the handle are joined together, by adhesive or staples, to deter the carrier from collapsing to a flattened position.

The majority of container carriers today are preferably formed from a plastic material due to the ease and lower cost of manufacturing and the strength of the material. An example of a prior carrier is shown in U.S. Pat. No. 4,219,117. The plastic carrier is stretched over the containers which are to be held within the carrier. The single sheet concept of U.S. Pat. No. 2,650,128 to Failor with its glued or stapled handle is not readily adaptable to be used with a plastic material because the joint created by gluing or stapling will not withstand the stresses created by stretching the plastic material around the containers without breaking or shearing.

The present invention is intended to overcome or minimize this problem as well as to present several new advantages.

OBJECTS AND SUMMARY OF THE INVENTION

A general object of the present invention is to provide a novel plastic carrier for carrying containers, such as bottles or cans and the like.

An object of the present invention is to provide a plastic carrier which has container engaging portions which extend freely from a joint.

Another object of the present invention is to provide a carrier that includes a joint made of a triple layer of plastic material.

A specific object of the present invention is to provide a carrier that includes a joint between container engaging portions which can permit the stretching of the carrier as it is applied over a plurality of containers without breaking or shearing.

Briefly, and in accordance with the foregoing, the present invention discloses a plastic carrier for carrying containers. The carrier includes container engaging portions which freely extend from a joint which is at adjacent edges of the container engaging portions. The container engaging portions include a plurality of annular bands for securely holding containers therein. The joint is formed by heat sealing or fusing adjacent surfaces of the container engaging portions preferably with a layer of plastic material between the edges of the container engaging portions to form a triple layer of thickness of plastic material at the joint. The joint is interrupted along its length to enable the carrier including container engaging portions to stretch when the carrier is applied to the containers. The carrier may include a handle portion which extends from the joint.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
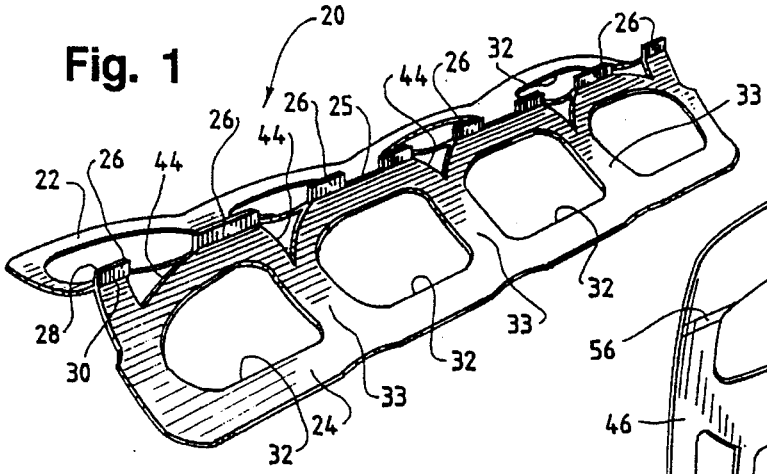
FIG. 1 is a perspective view of a first embodiment of a container carrier which incorporates features of the present invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

In FIG. 1, a first embodiment of a carrier 20 which incorporates features of the present invention is shown. The carrier 20 is used for carrying containers, such as bottles and the like.

The carrier 20 includes body portions or container engaging portions 22, 24 a predetermined thickness. The portions are connected by a seam or joined portion 26 at 25 which forms a strong, fused joint. The seam or joined portion 26 joins the container engaging portions 22, 24 along top or adjacent edges 28, 30 of the container engaging portions 22, 24. The container engaging portions 22, 24 freely extend from the joined portion 26. The seam or joined portion 26 projects generally perpendicular to the plane of the portions 22 and 24 when the carrier 20 is assembled with containers.

Figure 3:
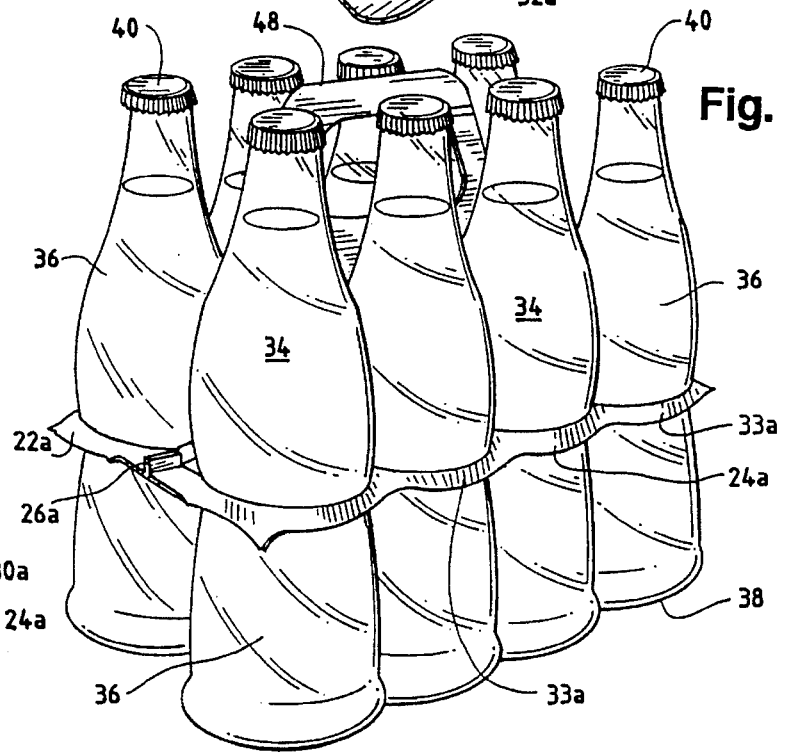
FIG. 3 is a perspective view of the embodiment of the container carrier of FIG. 2 with containers held therein.

The container engaging portions 22, 24 include a plurality of apertures 32 defined by annular bands 33 for securely holding therein containers, such as bottles, cans and the like. For example, as shown in FIG. 3, the containers 34 are a plurality of bottles which are securely held within the apertures 32 in the carrier 20 by the resiliently stretched bands 33. Each bottle 34 includes a side wall 36, a bottom wall 38 and a top or cap 40. Alternatively, the carrier 20 may be used to carry typical beverage cans.

The carrier 20 is made of a suitable flexible, resilient, stretchable material, such as plastic. Preferably, the carrier 20 is made of a low density polyethylene so that the carrier 20 can be stretched over the containers 34 and conform to the side walls 36 of the containers 34. The carrier 20 may be applied to the containers 34 by known means, for example, by the machines disclosed in U.S. Pat. No. 4,250,682 to Braun or U.S. Pat. No. 3,204,386 to Creed et al. It is noted that when the carrier 20 is stretched over the containers 34 the individual bands 33 are stretched and the overall length of the carrier is increased.

As explained in detail hereinbelow with reference to FIG. 5, the joined portion 26 is formed by extruding a strip or layer of resilient, stretchable material 42, such as plastic, preferably the same low density polyethylene material that forms the carrier 20, between the edges 28, 30 of the container engaging portions 22, 24. Thus, a triple layer of plastic material forms the joined portion 26. The three layers of plastic material (the container engaging portions 22, 24 and the layer of extruded plastic 42) are sufficiently melted and merged together by known means, preferably by heat sealing and fusing the layers together, to form a strong, integral bond. When the layers 22, 24, 42 of plastic material are merged together by heat sealing, the layers 22, 24, 42 are no longer distinguishable from each other and become one mass having a thickness greater than the combined thickness of the layers 22 and 24 alone.

The seam or joined portion 26 extends along the edges 28, 30 of the container engaging portions 22, 24. In order to permit the region 25 to react longitudinally to stresses created when the carrier 20 is applied to the containers 34, the joined portion 26 is interrupted along its length by cutouts 44 which form apertures between the container engaging portions 22, 24. The cutouts 44 allow the container engaging portions 22, 24 and the joined portion 26 to easily stretch transversely and in a longitudinal direction with respect to the seam or joined portion 26 and to conform to the containers 34 when the carrier 20 is applied to the containers 34. Segments of the seam 26 which are initially spaced apart by the cutouts 44, are spread longitudinally of the carrier 20 when the bands 33 are stretched over the containers 34 with the result that the overall length of the carrier 20 is increased in the final package. Since the joined portion 26 is formed by fused material and preferably by a triple layer of plastic material, the bond created is sufficiently strong to prevent the joined portion 26 from shearing or breaking when the carrier 20 is stretched during application to the containers 34.

Preferably, the carrier 20 of the present invention is formed by joining two separate sheets of plastic material together at the seam or joined portion 26. However, it is within the scope of the invention that a single sheet of plastic material may be used to form the carrier 20 by folding the sheet in half and applying a layer of plastic or otherwise fusing the sheets together to form the joined portion 26.

Figure 2:
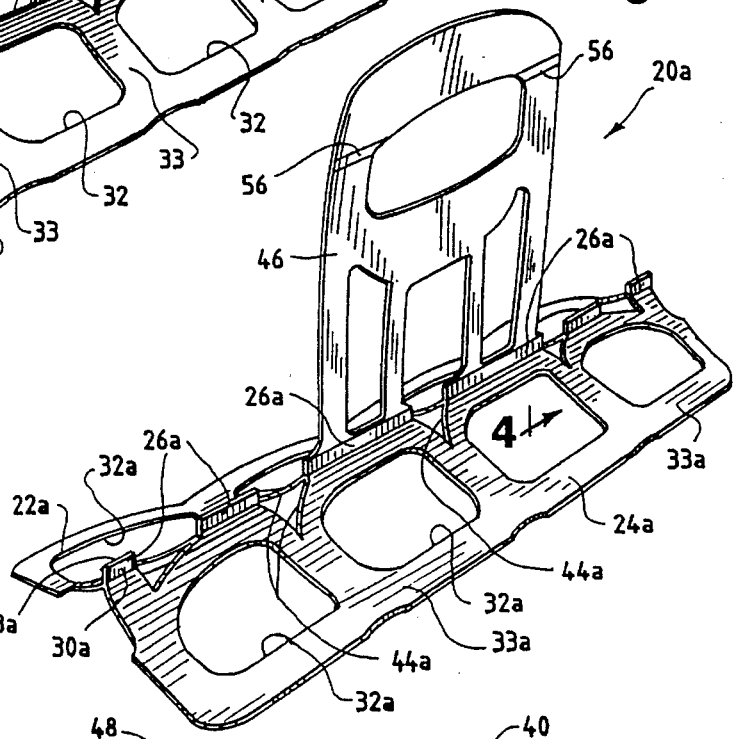
FIG. 2 is a perspective view of a second embodiment of a container carrier which incorporates features of the present invention.

The second embodiment of the carrier 20*a*, as shown in FIG. 2, is identical to the first embodiment of the carrier as shown in FIG. 1, except for the differences noted hereinbelow. The components of the carrier 20*a* which are identical to the carrier 20 are identified with the same numerals but with an "a" after the numeral.

The carrier 20*a* as shown in FIG. 2 includes a handle portion 46 which extends upwardly from the center of the carrier 20*a*. When the carrier 20*a* is applied to the containers 34, the top 48 of the handle portion 46 may extend upwardly from the top of the containers 34, or alternatively, as shown in FIG. 3, the top 48 of the handle portion 46 may lie even with the top of the containers 34.

If the carrier 20*a* is made of two separate sheets of plastic material, which is the preferred embodiment, the handle portion 46 also includes the two separate sheets of plastic material. Alternatively, if the carrier 20*a* is made out of a single sheet of plastic material, the handle portion 46 is formed when the sheet is folded in half. In either method, the handle portion 46 includes two sides portions 50, 52.

The joined portion 26*a* is formed at the base 54 of the handle portion 46 and at the top edge 28*a*, 30*a* of the container engaging portions 22*a*, 24*a* and the handle portion 46 extends upwardly from the joined portion 26a. A bond 56, preferably formed by heat sealing, is provided along an upper portion of the handle portion 46 to prevent the side portions 50, 52 of the handle portion 46 from separating thereby making the handle portion 46 easy to grasp by a consumer. The bond 56 merges the two layers of plastic material together to form a double thickness of material along the bond 56 as clearly shown in FIG. 4. It is within the scope of the invention that the handle portion 46 may be formed by extruding a layer of plastic material to create a triple thickness identical to that of the joined portion 26*a*.

Figure 4:
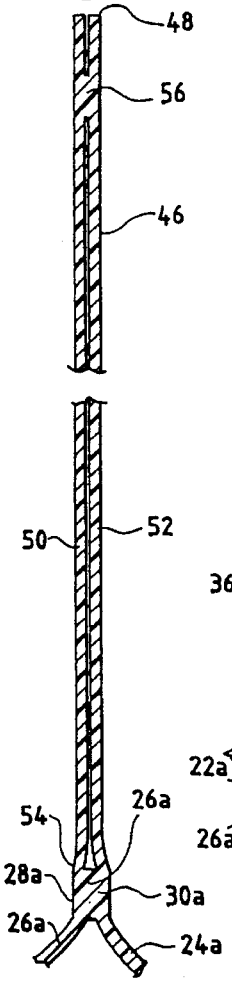
FIG. 4 is cross sectional view of the carrier of FIG. 2 along line 4—4.

The thicknesses of the heat sealed joined portion 26*a* and the bond 56 are illustrated in FIG. 4 and have been somewhat exaggerated for a better understanding of the description herein. Thus, the double thickness in the plastic material formed by the bond 56 in the handle portion 46 is shown. The triple thickness in the plastic material formed at the joined portion 26 by the container engaging portions 22*a*, 24*a* and the extruded layer 42 of plastic is also shown.

Now that the specifics of the carriers 20, 20*a* which incorporate features of the present invention have been described, a general description of the method for making the carrier 20*a* will be described. The method for making the carrier 20*a* is schematically illustrated in FIG. 5 in a simplified form. The same method is used for making the carrier 20 except for the differences noted herein.

Figure 5:
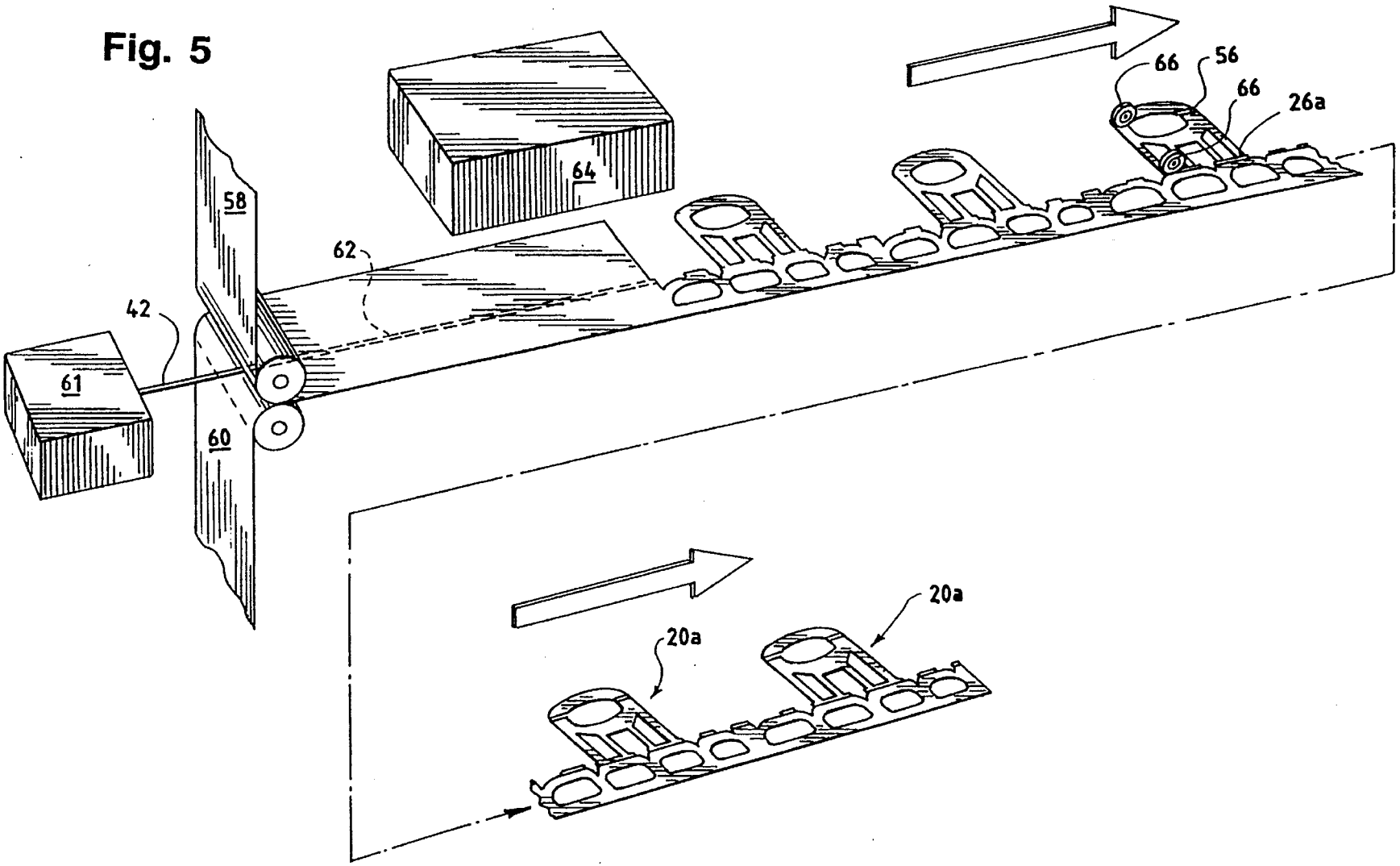
FIG. 5 is a simplified, schematic view of the apparatus for producing a carrier according to the present invention.

The carriers 20*a* are formed in a continuous method as described hereinbelow and as illustrated in FIG. 5. Preferably, a first sheet 58 of plastic material and a second sheet 60 of plastic: material are used. The first sheet 58 and the second sheet 60 are combined together. At the combining step, a layer or strip of plastic 42, preferably low density polyethylene, is continuously extruded between the sheets 58, 60 by an extruder 61 of known construction and by known methods to create a bond 62 between the sheets 58, 60.

The combined sheets 58 60 of plastic material are then stamped by a stamping die 64, of known construction, to form a continuous strip of carriers 20*a*. The stamping die 64 punches both sheets 58, 60 simultaneously to form the carrier 20*a* and the apertures 32. To form the carrier 20 the stamping die 64 does not stamp a handle portion 46. In either embodiment, a plurality of lines of cutouts creating apertures for container receiving portions and/or handles can be formed simultaneously.

The carrier 20*a* is then heat sealed along the bond 62 to form the triple layer of thickness of material at the top edge 28*a*, 30*a* of the container engaging portions 22*a*, 24*a*. The handle portion 46 is also heat sealed at this time to create the double layer of thickness of material. The continuous web of carriers 20*a* are then rolled or otherwise appropriately stored until they are to be applied to the containers 34 by known methods. The structure and process of this invention thus provides degrees of manufacturing flexibility to produce integral carriers having features not capable of being created using existing technology, The heat sealing may be done by conventional, known methods, such as by heated rollers 66. It is within the scope of the invention that the stamping step and the heat sealing step may be interchanged. It should also be recognized that regions 26, 26*a* and 56 can be created by fusing the carrier material directly together without the additional extrusion 42, or alternatively in some cases a strip of heat sensitive or pressure sensitive adhesive may be inserted at desired locations between sheets 58 and 60.

While preferred embodiments of the present invention are shown and described, it is envisioned that those skilled in the art may devise various modifications of the present invention without departing from the spirit and scope of the appended claims. The invention is not intended to be limited by the foregoing disclosure.

The invention claimed is:

1. A carrier for carrying a plurality of containers comprising:

first and second container engaging portions made of a plastic material of a predetermined thickness and freely extending from a joined portion of a predetermined length at adjacent edges of said container engaging portions;

said joined portion being formed by merging juxtaposed surfaces of longitudinal edges of said container engaging portions together; and said container engaging portions including a plurality of annular bands defining apertures therein for respectively securely holding therein a single container, each said annular band having a height defined by said thickness of the plastic material and a radial width defined by the distance between an outer margin of its aperture and an outer margin of the band, said radial width being substantially greater than said height of the band;

said container engaging portions generally defining a plane along said radial width when the carrier is assembled with containers, said joined portion extending generally perpendicularly with respect to said plane when the carrier is assembled with containers and said joined portion being interrupted along its length to define cut outs between said bands and separated joined portion segments.

2. A carrier as defined in claim 1, wherein said container engaging portions and said juxtaposed surfaces are merged together by heat sealing.

3. A carrier as defined in claim 1, further including an initially separate layer of plastic between said juxtaposed surfaces of said edges which form said joined portion so as to form triple layer of thickness plastic material at said joined portion.

4. A carrier as defined in claim 1, further including handle portion extending from said joined portion.

5. A carrier as defined in claim 1, wherein said container engaging portions are formed by first and second sheets of plastic material joined together by said joined portion.

6. A carrier as defined in claim 5, further including a handle portion extending from said joined portion, said handle portion being formed from said first and second sheets joined together at a bond.

7. A carrier as defined in claim 6, wherein said first and second sheets which comprise said handle portion are bonded together by a heat seal.

8. A carrier as defined in claim 1, wherein each container engaging portion includes at least two juxtaposed apertures and said joined portion is interrupted to form one of said cut outs in regions intermediate said juxtaposed apertures.

9. A carrier as defined in claim 1, wherein said joined portion is interrupted to form joined portion segments at opposite extremities of the carrier and in regions directly intermediate each aperture.

10. A carrier for a plurality of containers comprising:

first and second generally planar container engaging portions of plastic sheet material of predetermined thickness and having first longitudinal inner edge margins and opposite outer edges, said inner edge margins having fused facing surfaces providing a joined portion of predetermined length, said container engaging portions including a plurality of annular, substantially planar bands defining apertures therein, each aperture for respectively receiving and retaining a single container, said generally planar container engaging portions being positionable in a first position wherein said container engaging portions extend in the same direction from said joined portion with said outer edges of said container engaging portions adjacent each other and said apertures of said container engaging portions respectively juxtaposed over one another, said generally planar container engaging portions being movable to a second position wherein said container engaging portions are folded oppositely from said joined portion substantially to a common plane for assembly with containers and said joined portion extends generally perpendicularly with respect to said common plane when the carrier is assembled with containers.

11. A carrier as defined in claim 10, further including an initially separate layer of plastic between said facing surfaces of said inner edge margins which form said joined portion so as to form a triple layer of thickness of plastic material at said joined portion.

12. A carrier as defined in claim 10, wherein said joined portion is interrupted along its length to form separate joined portion segments in regions directly intermediate each aperture.

13. A carrier as defined in claim 12, wherein said joined portion is interrupted along its length to form separate joined portion segments at opposite extremities of the carrier and in regions directly intermediate each aperture.

* * * * *